US011021889B2

(12) United States Patent
Portal

(10) Patent No.: US 11,021,889 B2
(45) Date of Patent: Jun. 1, 2021

(54) SATURATED BURIAL CONSTRUCTION SYSTEM AND METHOD

(71) Applicants: R. Portal Project Management Ltd., Ashkelon (IL); Ronen Portal, Ashkelon (IL)

(72) Inventor: Ronen Portal, Ashkelon (IL)

(73) Assignee: R. PORTAL PROJECT MANAGEMENT LTD., Ashkelon (IL)

( * ) Notice: Subject to any disclaimer, the term of this patent is extended or adjusted under 35 U.S.C. 154(b) by 0 days.

(21) Appl. No.: 16/055,100

(22) Filed: Aug. 5, 2018

(65) Prior Publication Data

US 2019/0048612 A1 Feb. 14, 2019

(30) Foreign Application Priority Data

Aug. 9, 2017 (IL) ..... 253936

(51) Int. Cl.
*E04H 13/00* (2006.01)
*A61G 17/007* (2006.01)

(52) U.S. Cl.
CPC ..... *E04H 13/006* (2013.01); *A61G 17/0136* (2017.05)

(58) Field of Classification Search
CPC ..... E04H 13/006; A61G 17/0136
USPC ..... 52/136, 426, 562
See application file for complete search history.

(56) References Cited

U.S. PATENT DOCUMENTS 2,134,894 A * 11/1938 Schubert ..... E04B 2/30 52/568
3,541,747 A * 11/1970 Olson ..... E04H 13/00 27/3
3,868,799 A * 3/1975 Hayward ..... E04H 13/00 137/855
3,898,718 A * 8/1975 Eubank ..... A61G 17/00 27/29
4,253,220 A * 3/1981 Work ..... A61G 17/00 27/35
4,288,952 A * 9/1981 Work ..... E04H 13/00 27/35
4,439,967 A * 4/1984 Dielenberg ..... E04B 2/26 52/309.12
4,598,530 A 7/1986 Barnes et al.
(Continued)

FOREIGN PATENT DOCUMENTS

ES 1075910 12/2011
ES 2534730 4/2015
(Continued)

*Primary Examiner* — Basil S Katcheves
(74) *Attorney, Agent, or Firm* — Sughrue Mion, PLLC

(57) ABSTRACT

A burial system comprising: one or more rectangular burial spaces, each confined by grave walls generated by cutting with a filament from a block of foamed polystyrene or other expanded polystyrene substance, thereby enabling reducing weight of burial elements of the burial system by at least 90% in comparison to concrete burial elements (the prior art), and providing ease of construction effort in comparison to concrete burial systems. The innovative saturated burial system is supposed to sustain for hundreds of years. The saturated burial system may be applied on a single burial arrangement, as well as on a double burial arrangement, and a multi-story crypt burial arrangement.

20 Claims, 13 Drawing Sheets

(56) References Cited

U.S. PATENT DOCUMENTS 4,884,382 A * 12/1989 Horobin ..... E04B 2/8641 52/426
5,172,532 A * 12/1992 Gibbar, Jr. ..... E04B 2/8652 52/309.12
5,261,199 A * 11/1993 Schmidt ..... A61G 17/00 206/519
5,381,591 A 1/1995 Ponger et al.
5,471,718 A * 12/1995 Harrill ..... A61G 17/00 220/669
5,485,661 A * 1/1996 McClure ..... A61G 17/00 27/17
5,570,552 A * 11/1996 Nehring ..... E02D 27/02 249/91
5,899,045 A 5/1999 Giannarelli
5,960,524 A * 10/1999 Darby ..... A61G 17/02 27/10
6,370,745 B1 4/2002 Kele et al.
7,458,138 B2 * 12/2008 Spiers ..... E04H 13/00 27/29
7,636,991 B1 * 12/2009 Scalisi, III ..... E04H 13/00 27/1
8,443,496 B2 * 5/2013 De La Fuente ..... A61G 17/00 16/424
8,745,932 B2 * 6/2014 Fisher ..... E04H 13/001 52/133
10,378,204 B2 * 8/2019 Gosain ..... E04B 2/8652
2003/0033781 A1 * 2/2003 Schmidt ..... E04B 2/8617 52/426
2006/0117693 A1 * 6/2006 Garrett ..... E04B 2/8647 52/426
2007/0044405 A1 * 3/2007 Straub ..... E04B 2/8629 52/309.11
2009/0013629 A1 * 1/2009 Boeshart ..... E04B 2/8617 52/426
2011/0030181 A1 * 2/2011 Williamson ..... A61G 17/00 27/14
2011/0072753 A1 * 3/2011 MacDonald ..... E04B 2/14 52/562
2012/0096797 A1 * 4/2012 Garrett ..... E04B 2/8635 52/426
2013/0067705 A1 * 3/2013 Williamson ..... A61G 17/02 27/14
2013/0125490 A1 * 5/2013 Crosby ..... E04C 5/07 52/309.4
2013/0263544 A1 * 10/2013 Pfeiffer ..... E04B 1/7608 52/407.1
2014/0208553 A1 * 7/2014 Schwab ..... E04H 13/00 27/7
2015/0013124 A1 * 1/2015 Bailey ..... A61G 17/007 27/1

FOREIGN PATENT DOCUMENTS

IL 108493 1/1994
IL 201598 10/2009

* cited by examiner

SATURATED BURIAL CONSTRUCTION SYSTEM AND METHOD

TECHNICAL FIELD

The present invention relates to the field of burial construction and methods.

BACKGROUND ART

Presently, plots of land available for burial are running low near any densely populated city; Jerusalem, ISRAEL, for example. The residents of the city prefer to bury their loved ones near their places of residence, and therefore planners are now required to plan and implement denser burial structures, such as 1500-3000 graves per 1,000 square meters. These structures are called "saturated burial constructions". Such constructions are expensive because of the soil, precast elements of graves which are usually made of pre cast concrete, the heavy gravestones, and the visitors which add up to a very heavy load.

According to Jewish religious rulings ("Halacha"), burial can be carried out on flooring, provided that each deceased is placed on soil, and the soil connected to the "world" (ground). In addition, horizontal and vertical distances are permitted, and there are many halachic rulings on the subject. In underground systems, for instance, plates are placed above the deceased's body and soil is filled there above.

The following burial structure types are common:

Field burial, which is an underground burial in an area of 2-2.5 square meters for each deceased person;

Family burial, which is underground burial of two or more deceased persons on an area of 2-2.5 square meters for the number of deceased, usually a couple; and Multi-story crypt burial, which is a burial in buildings above the ground, creating horizontal burial cavities with an opening in front for the entrance of the deceased. Following interment, the front plate is sealed.

In all underground systems, the horizontal distance between the center of a grave and the center of the nearby grave ranges from 80-150 cm in width, and 200-300 cm in length. In the Multi-story crypt burial, the horizontal distance between the center of a grave and the center of the nearby grave ranges between 85-120 cm, and the vertical distance between the center of a grave to the center of the grave above it is 70-90 cm.

Throughout the world, similar use of burial structures is made, while building density is adapted according to local needs and customs.

The Israeli Ministry of Religious Services issued the following opinion on this matter:

"Due to the shortage of land reserves for burial in the State of Israel, the Ministry is working to find effective solutions for the issue of burial in Israel and promotes the issue of saturated burial and the establishment of regional cemeteries.

Saturated burial: Until recent years, deceased were buried in the State of Israel in a field burial. With the natural increase of the country's population and the depletion of land reserves for burial, the ministry is required to find alternative solutions in existing and new cemeteries. Today there are a number of burial possibilities that are saturated/laminated according to Orthodox Jewish law, including:

Double burial: This burial takes place deep in the ground. The burial company "Hevra Kadisha" digs a grave deep in the ground. The first deceased will be buried at the bottom of the grave, he will be covered with the stones and the soil according to the Halacha requirements, and the second deceased will be buried on his back.

Sanhedrin burial (floors): This burial takes place in burial halls built according to the Halacha. The deceased is placed by a special bed into a niche like the Sanhedrin's graves, which were exposed in Jerusalem and elsewhere in the country.

Multi-level burial: This burial is carried out in a multi-story building, with each floor bringing the deceased to burial in a field burial or in a couple or family burial."

(From the Website of The Israeli Ministry of Religious Services http://www.dat.gov.il/DeathAndInterment/Pages/BurialSatura tion.aspx)

The following publications are considered by the Applicant as the closest prior art:

U.S. Pat. Nos. 5,899,045, 6,370,745, and 5,381,591; and Israeli Patents 108493 and 201598.

As mentioned above, the structures for the burial of previous knowledge are expensive because the soil, the graves made of pre cast concrete, the heavy gravestones and the people who visit the cemetery are very heavy and therefore these structures are expensive to plan and build (Up to 10 tons per square meter).

It is an object of the present invention to provide a solution to the above mentioned and other problems of the prior art.

Other objects and advantages of the invention will become apparent as the description proceeds.

SUMMARY OF THE INVENTION

"Expanded polystyrene (EPS) is a rigid and tough, closed-cell foam with a normal density range of 11 to 32 kg/m$^3$. It is usually white and made of pre-expanded polystyrene beads. EPS is used for many applications e.g. trays, plates, bowls and fish boxes. Other uses include molded sheets for building insulation and packing material ("peanuts") for cushioning fragile items inside boxes. Sheets are commonly packaged as rigid panels (size 4 by 8 or 2 by 8 feet in the United States).

Due to its technical properties such as low weight, rigidity, and formability, EPS can be used in a wide range of applications." (From Wikipedia)

In one aspect, the present invention is directed to a burial system comprising: one or more rectangular burial spaces, each confined by grave walls generated by cutting with a filament from a block of foamed polystyrene or other expanded polystyrene substance, thereby enabling reducing weight of burial elements of the burial system by at least 90% in comparison to concrete burial elements (the prior art), and providing ease of construction effort in comparison to concrete burial systems, and suppose to sustain for hundreds of years.

Preferably, each of the grave walls comprises a recess on its four parallel corners, for allowing integrating the grave wall with an adjacent grave wall.

According to one embodiment of the invention, each of the grave walls is used as a longitudinal wall of a grave space, and the latitudinal wall of the grave space is derived from the longitudinal wall by means of filament cutting.

Preferably, each of the grave walls is coated by concrete reinforced by a fiberglass or polymeric network or polymer fibers, for preventing collapse thereof due to bending loads.

The burial system may be applied on a single burial arrangement, as well as on a double burial arrangement, and a multi-story crypt burial arrangement.

The burial system may be applied in a plurality of floors, wherein in each floor is installed a horizontal matrix of burial spaces, thereby requiring a less massive and lightweight construction in comparison to precast and conventional concrete burial systems.

According to one embodiment of the invention, the burial spaces are covered by a concrete layer having cavities correspondingly to the burial spaces, for enabling access to each of the burial space.

Preferably, the inner side of each of the grave walls is used for deriving thereof additional construction blocks of the system.

The burial may further comprise a shaft for each burial space, the shaft being generated between two adjacent graves or via a vertical hole in each of the grave walls, to be filled by soil for generating a connection between the graves and the earth in order to correspond with Jewish burial regulations, or to be filled by reinforced concrete for strengthening the construction thereof.

In another aspect, the present invention is directed to a saturated burial method, comprising the steps of:

providing expanded polystyrene blocks in a box form, each weighing up to 70 kg/m$^3$;

cutting each of the blocks to sub-blocks comprising connection means to each other in a form of a prismatic recesses; and placing the sub-blocks in the form of a matrix of burial places where the blocks are integrated to each other for preventing the movement of one block relative to the other.

According to one embodiment of the invention, the cutting is carried out by means of a filament movable by computer means.

The method may be applied on a single burial arrangement, as well as on a double burial arrangement, and a multi-story crypt burial arrangement.

An expanded polystyrene grave wall weighs only 3% of a pre cast concrete grave wall. As such, the use of expanded polystyrene as a substitute for a concrete structure results in an obtained structure weighing significantly less than concrete burying technology, possibly only 50% of the weight of a concrete burying building. It is easy and quick to assemble, and cheap in terms of construction. The reduced weight in relation to the prior art enables the construction of burial systems on floors (such as the Israeli Yarkon cemetery), which are much less heavy and there for economical.

The present invention meets all requirements of Jewish law, and has received halakhic approval from rabbis specializing in Jewish burial.

All burial systems performed according to this invention are structurally correct and carried out by elements of EPS (Expanded polystyrene) containing approximately 97% air, and their spatial weight ranges from 20-70 kg/m$^3$.

The present invention allows the replacement of all graves that presently are made of concrete or concrete building materials such as blocks, cast concrete on site and prefabricated concrete elements.

The use of expanded polystyrene elements that are lightweight (as mentioned above, up to 70 kg/m$^3$) makes it possible to install a grave system by manual working without any devices or cranes.

The present invention allows for a significant improvement of the performance and cost of saturated burial, especially in the use of a floor structure, such as the Israeli Yarkon cemetery.

The weight of the novel elements is up to 3% of the weight of prefabricated precast elements from reinforced concrete, and therefore represents a revolution in the execution of saturated burial.

The use of these lightweight blocks enables significant savings in the construction of the building, such as foundation, columns, and ceilings.

As mentioned above, the present invention enables substantial savings during assembly, use of cranes, safety and accuracy of the proposed systems, flexibility in the design of the systems in varying sizes, as required.

Since burial systems based on the present invention are designed to use EPS blocks, the special geometry being performed by a rectangular block of EPS and precise and computerized cutting with filament, the invention enables flexibility in relation to the methods in current use with the performance of prefabricated elements.

Presently, any request of a customer or architect as to a specific size of a grave requires the manufacturer of the prefabricated elements to design and build expensive steel molds. According to the present invention, the adaption to a new module is rapid and requires only generating new CNC files.

After making an appropriate infrastructure, all the elements are placed on top of the infrastructure, connect to each other and form a strong structure suitable for the content module. Cover plates consist of the ready-made protrusions and add the amount of ground required above the plates. A concrete plate is poured over the entire system, which distributes all the upper loads, including tombstones and people, throughout the system.

At the head and foot, an opening can be made to connect the land according to Jewish law.

In cases wherein the thickness of a long block does not satisfy the needs of the construction to withstand the loads of the tombstones and the public, a concrete column can be poured at the junction of each product, enabling the reduction of all usable loads to the ground/existing ceiling.

In the applying of multi-story crypt structure, the planned structure is designed to be structurally based on castings Reinforced concrete inside and above the block (the long wall). The other parts of a multi-story crypt, the back of the multi-story crypt, and the facade of the multi-story crypt are glued to the main block and the base plate.

BRIEF DESCRIPTION OF DRAWINGS

Preferred embodiments, features, aspects and advantages of the present invention are described herein in conjunction with the following drawings.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting.

For the sake of brevity, some well-known features, methods, systems, procedures, components, and so on, are not described in detail.

The reference numbers have been used to point out elements in the embodiments described and illustrated herein, in order to facilitate the understanding of the invention. They are meant to be merely illustrative, and not limiting.

The following embodiments of the invention have been described and illustrated in conjunction with systems and methods thereof, which are meant to be merely illustrative, and not limiting.

Single Burial System

Figure 1:
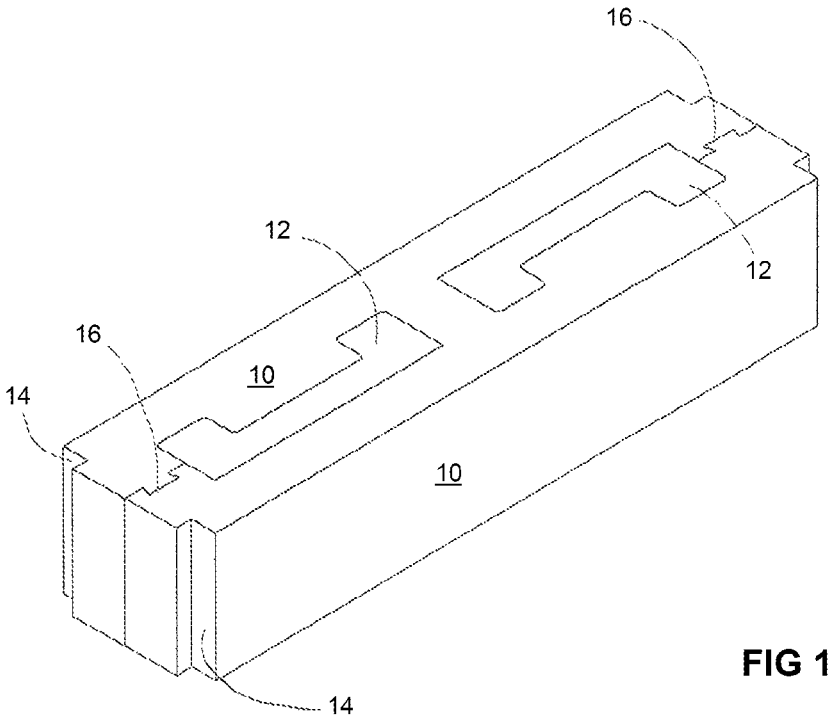
FIG. 1 schematically illustrates a grave wall, according to one embodiment of the invention.

FIG. 1 schematically illustrates a grave wall, according to one embodiment of the invention.

The grave wall, which is marked herein by reference numeral 10, is made of expanded polystyrene. This novel feature provides benefits to any burial system, such as relatively light weight, easy transportation (can be moved by a single worker without mechanical engineering equipment), and more.

The grave wall 10 can be shaped, for example, as a block in a box form, its four corners 14 in a form of a quadratic prismatic recess, in order to lock adjacent grave walls to each other, and spare measurements while constructing a burial system.

Since a burial space of a grave is in a form of a box (i.e., a rectangular cuboid), blocks 12 may be used as latitudinal walls of the burial space, while grave wall 10 is used as a longitudinal wall of the space.

In order to enable separation of blocks 12 from block 10, a cutting 16 may be performed in block 10 by a filament (not illustrated). The cutting 16 may be in form of a dovetail, in order to prevent the dissection parts from separation from each other when the space of the removed parts 12 is filled with soil.

It should be noted that the length of a longitudinal wall 10 is about twice the length of a latitudinal wall 12.

Each block 12 is in a form of a Π. Thus, when approaching two blocks 12, a space is generated therebetween.

Figure 2A:
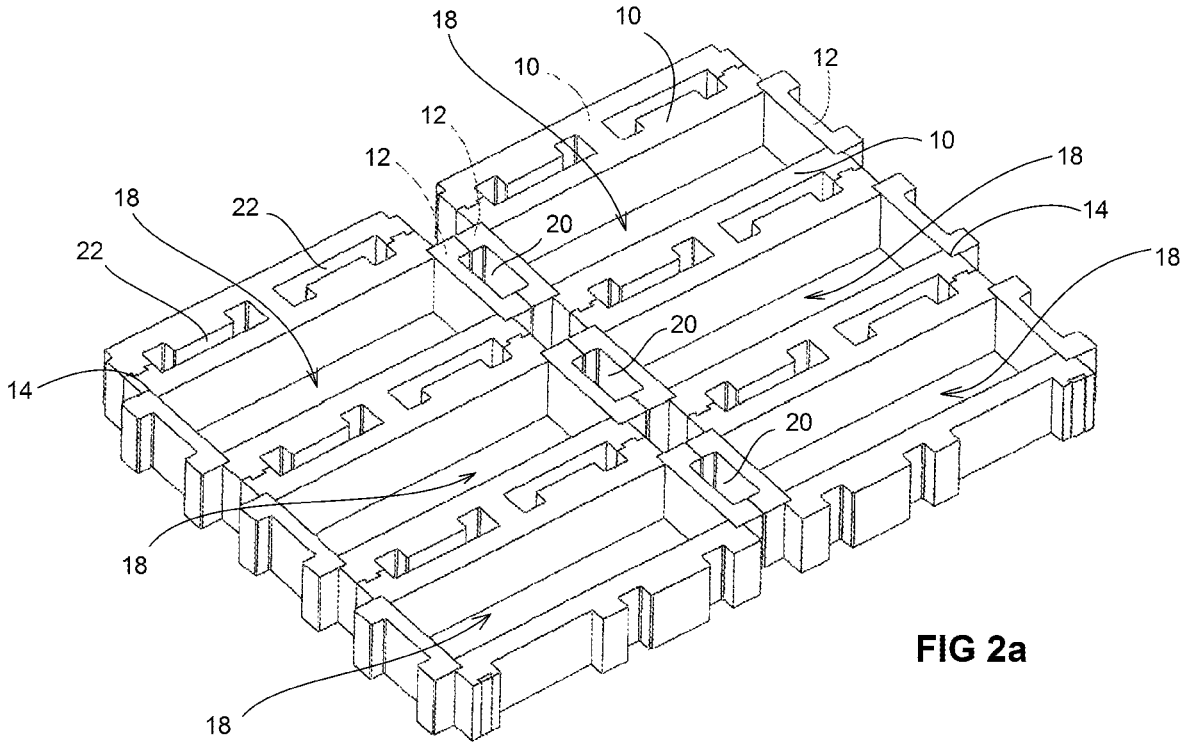
FIG. 2*a* schematically illustrates a single burial system, according to one embodiment of the invention.

FIG. 2*a* schematically illustrates a single burial system, according to one embodiment of the invention.

The burial spaces 18 are generated by longitudinal walls 10 and latitudinal walls 12. The latitudinal walls 12 are placed such that their corners are integrated into the recess of corners 14 of blocks 10, as illustrated in the figure.

Spaces 20, which are generated by two adjacent latitudinal blocks 12, may be filled with soil, up to the earth. Thus, according to the halachic regulations, the grave is placed on the earth. The spaces 22, which are of the removed elements 12, may also be filled with soil up to the earth.

It should be noted that the single burial system is dipped into the earth. On the expanded polystyrene walls a cement "hive" is casted. The fact that the single burial system is dipped into the earth prevents separation of the walls.

Figure 2B:
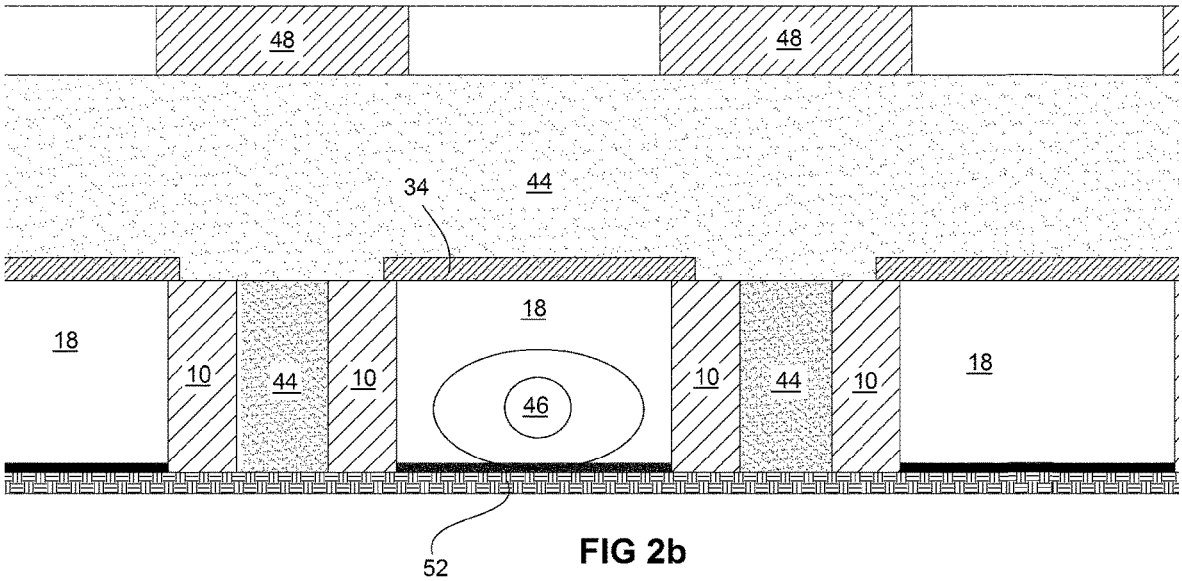
FIG. 2*b* is a latitudinal cross-section schematically illustrating a single burial system, according to one embodiment of the invention.

FIG. 2*b* is a latitudinal cross-section schematically illustrating a single burial system, according to one embodiment of the invention.

The burial spaces 18 are dug underground. Each grave space is confined by expanded polystyrene blocks 10, and a soil frame 44. On each of the grave spaces a grave cover plate 34 is placed. A soil layer is disposed over the graves matrix, and above the soil layer is disposed a concrete layer 48, which comprises spaces in a matrix form, on which gravestones are disposed. The graves' infrastructure is marked by numeral 52.

Double Burial System

Figure 3:
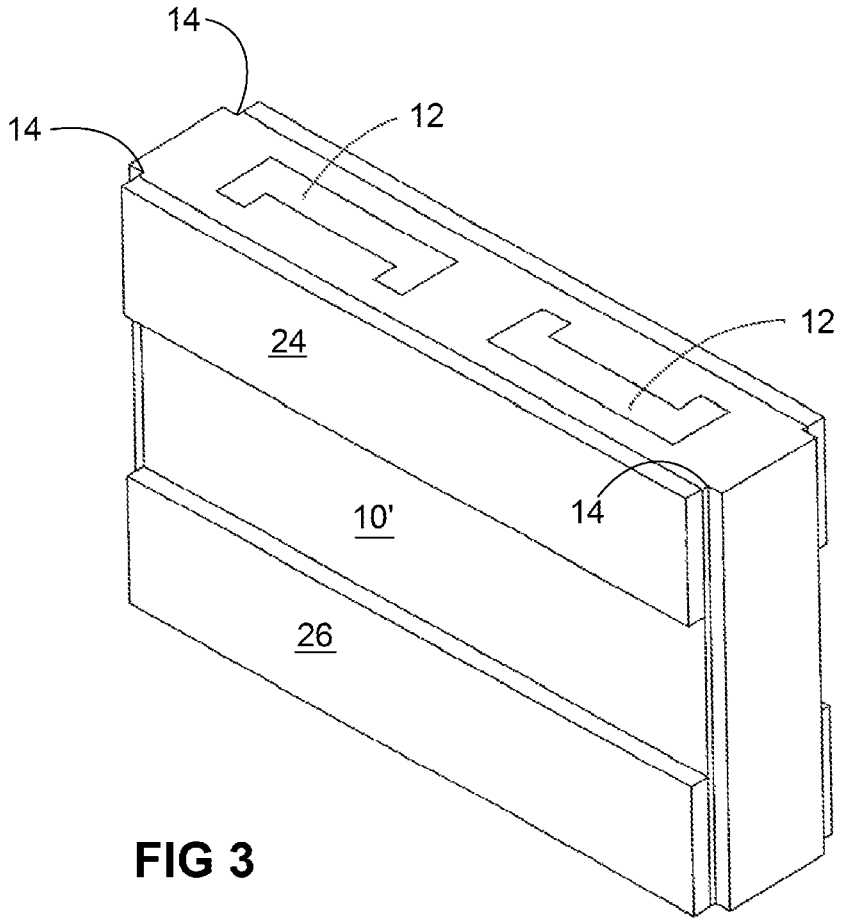
FIG. 3 schematically illustrates a grave wall, according to another embodiment of the invention.

FIG. 3 schematically illustrates a grave wall, according to another embodiment of the invention.

Figure 4:
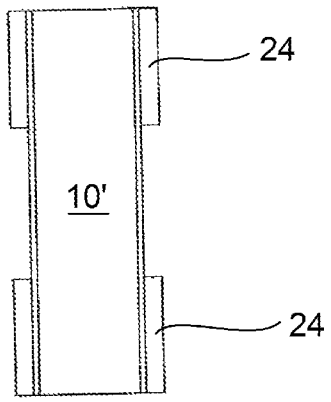
FIG. 4 is a side view thereof.
Figure 5:
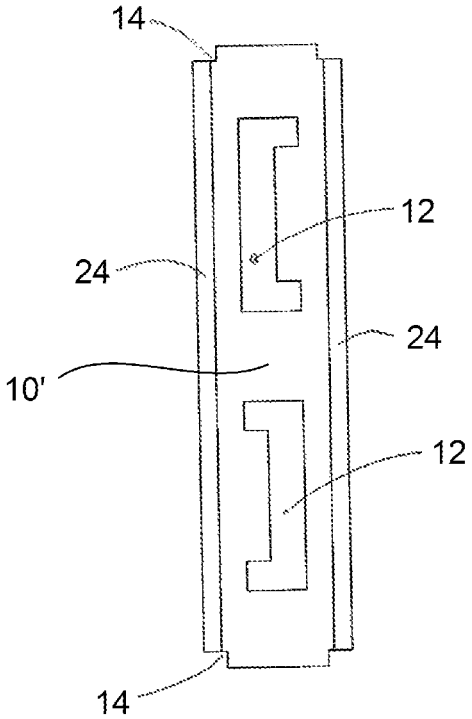
FIG. 5 is a top view thereof.

FIG. 4 is a side view thereof, and FIG. 5 is a top view thereof.

The grave wall, which is marked herein by reference numeral 10', is made of expanded polystyrene. As mentioned, this novel feature provides benefits to any burial system, such as relatively light weight, easy transportation (can be moved by a single worker without mechanical engineering equipment), and more.

The difference between grave wall 10 of the single burial system to grave wall 10' of the double burial system is that grave wall 10' also comprises two supporters: an upper supporter 24 and a lower supporter 26.

Figure 6:
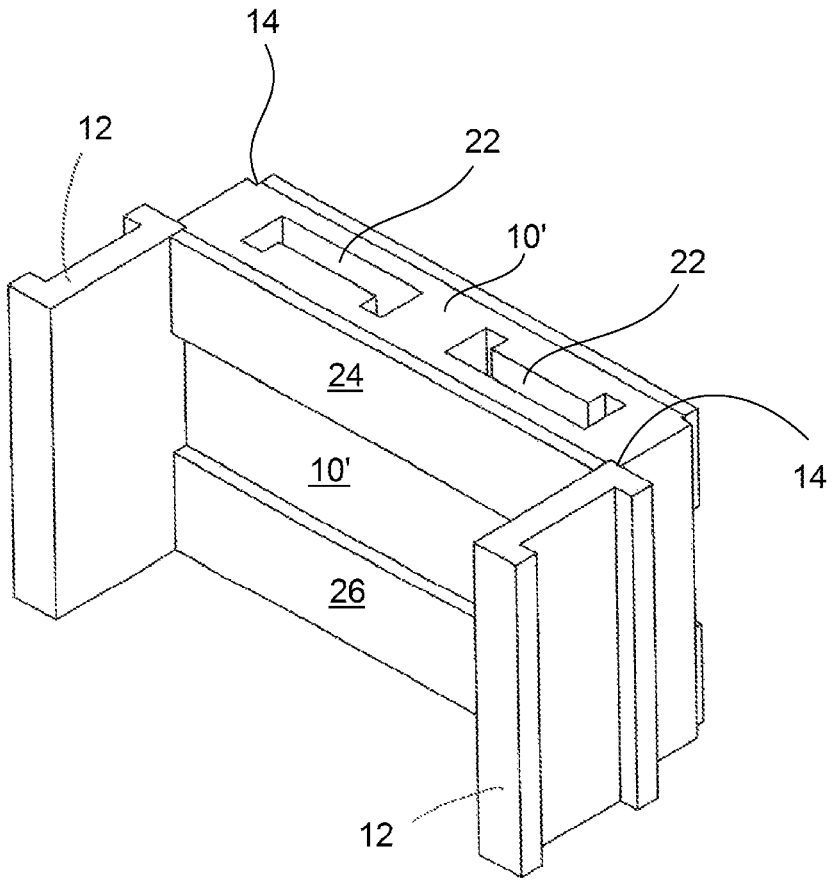
FIG. 6 schematically illustrates a stage in assembling a burial space in a double burial system, according to one embodiment of the invention.

FIG. 6 schematically illustrates a stage in assembling a burial space in a double burial system, according to one embodiment of the invention.

The latitudinal foamed polystyrene blocks 12 are placed in the recession 14 of a longitudinal block 10'.

The bottom (not illustrated) of the upper burial space is placed on lower supporter 26 of the latitudinal grave wall 10'.

Figure 7A:
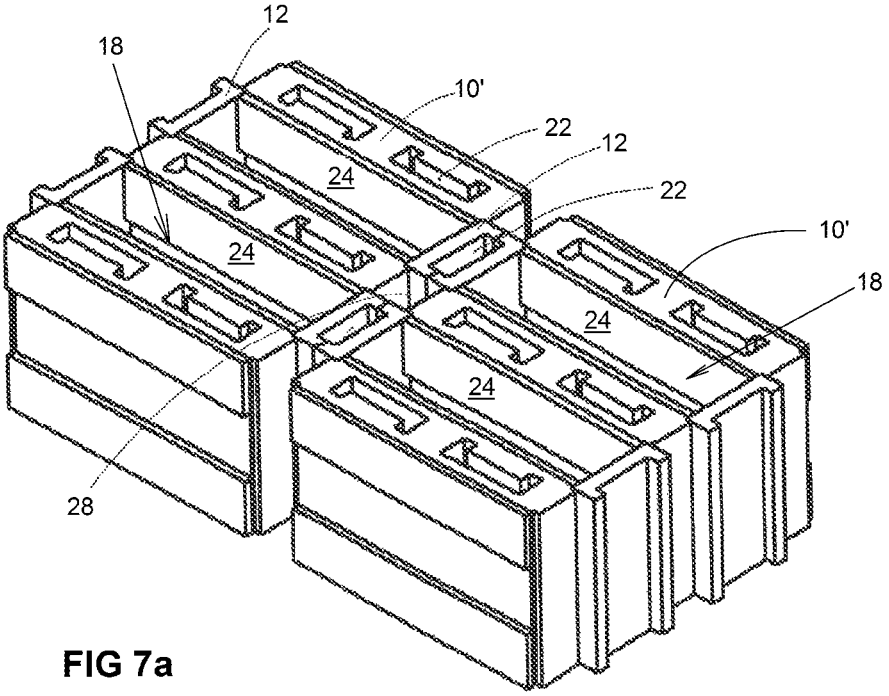
FIG. 7*a* schematically illustrates a double burial system, according to one embodiment of the invention.

FIG. 7*a* schematically illustrates a double system, according to one embodiment of the invention.

Figure 7B:
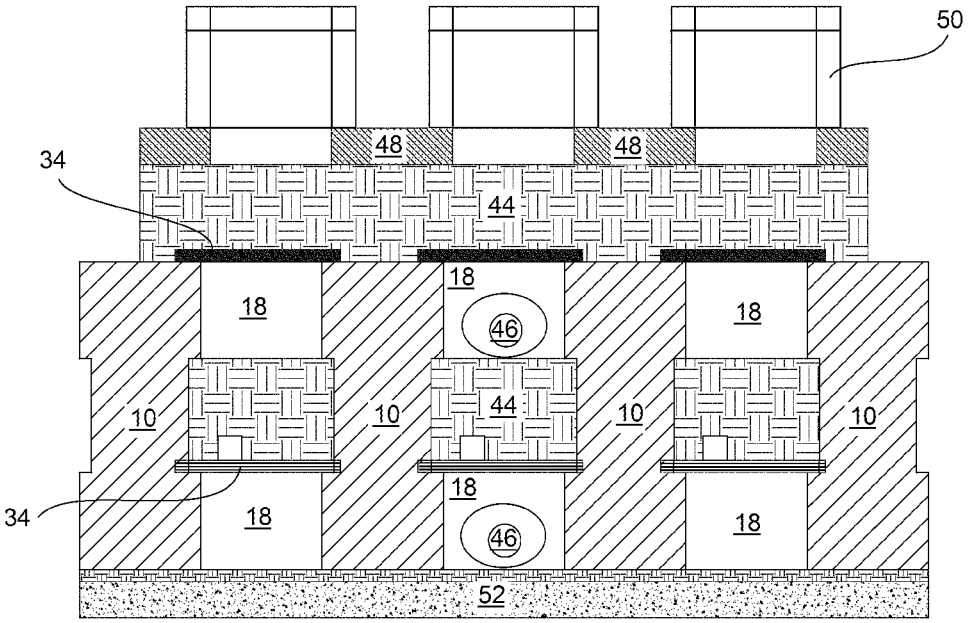
FIG. 7*b* is a latitudinal cross-section schematically illustrating a double burial system, according to one embodiment of the invention.

FIG. 7*b* is a latitudinal cross-section schematically illustrating a double burial system, according to one embodiment of the invention.

As illustrated, the cover 34 of the lower grave space 18 uses a floor for the lower grave space 18. Between the upper and lower grave spaces soil 44 is disposed. Each grave space is confined by expanded polystyrene blocks 10.

Over the graves matrix a soil layer is disposed, and above the soil layer a concrete layer 48, which comprises spaces in a matrix form, on which gravestones are disposed. The graves' infrastructure is marked by numeral 52.

Figure 8:
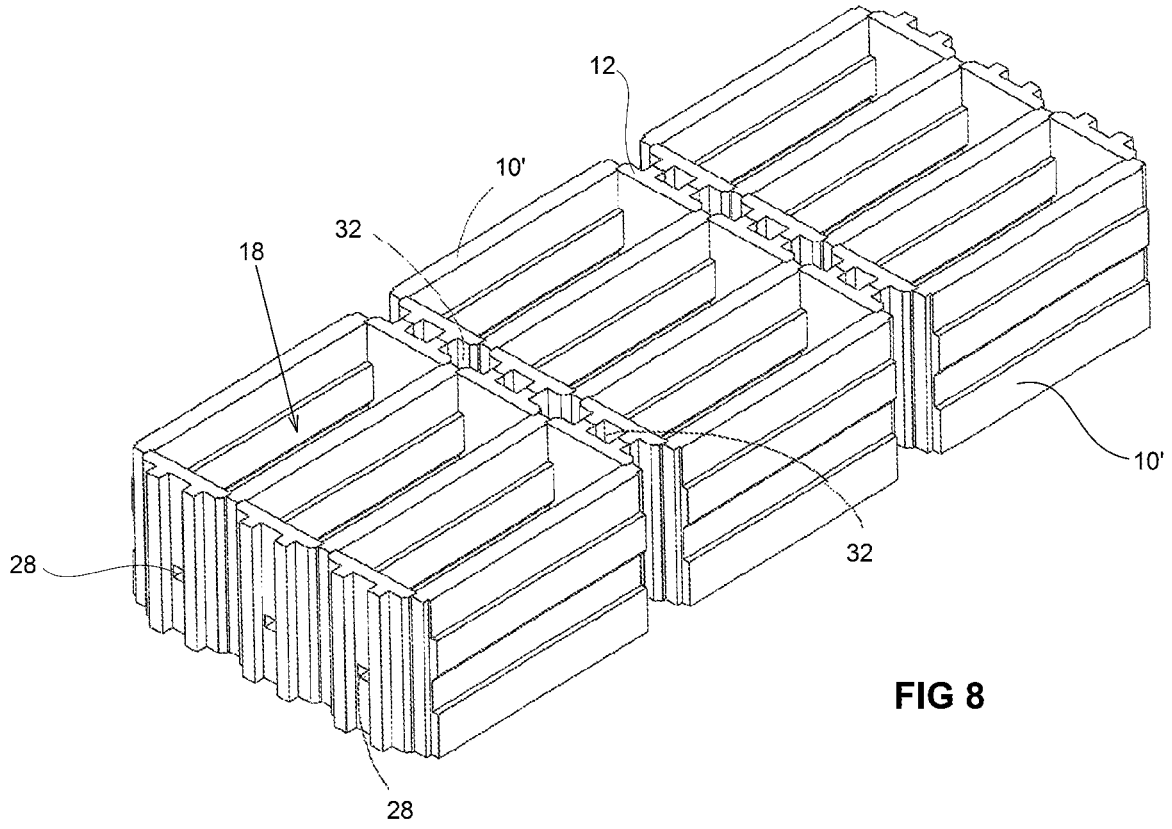
FIG. 8 schematically illustrates a double burial system, according to another embodiment of the invention.

FIG. 8 schematically illustrates a double burial system, according to another embodiment of the invention.

According to this embodiment of the invention, the longitudinal grave walls are not adequate for driving the latitudinal grave walls therefrom, and as such they are derived from other blocks (not illustrated in this figure).

Cavities 32, which are generated between two walls of adjacent grave spaces, may be filled with soil for providing soil sequence from the earth to the burial space 18, according to Jewish law. Horizontal cavity 28 may also be filled with soil for providing soil contact to the deceased buried therein.

Alternatively, the cavities may be filled with reinforced concrete, for strengthening the construction.

The entire burial system is protected from any possibility of movement.

Multi-Story Crypt Burial System

Figure 9:
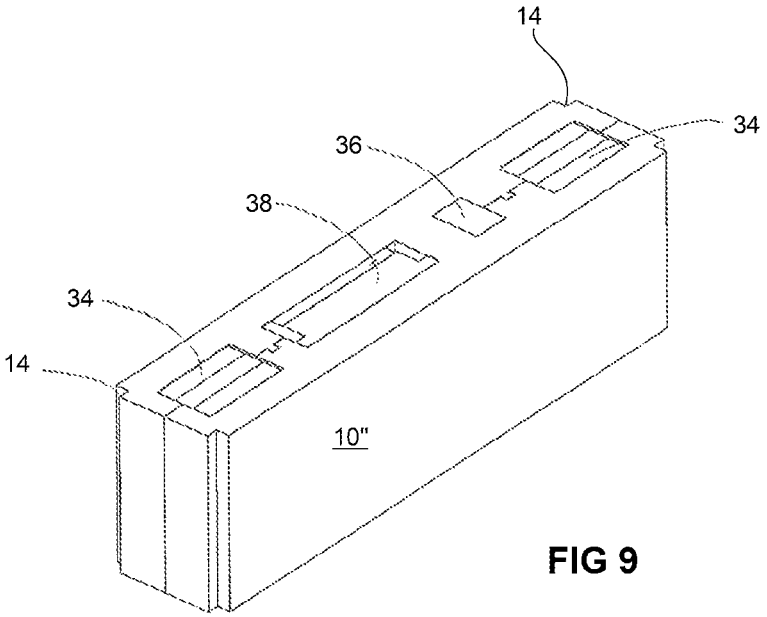
FIG. 9 schematically illustrates a grave wall, according to yet another embodiment of the invention.

FIG. 9 schematically illustrates a grave wall, according to yet another embodiment of the invention.

The grave wall, which is marked herein by reference numeral 10", is made of expanded polystyrene.

Each of reference numerals 34, 36, and 38, denotes a grave construction block, derived from block 10".

Figure 10:
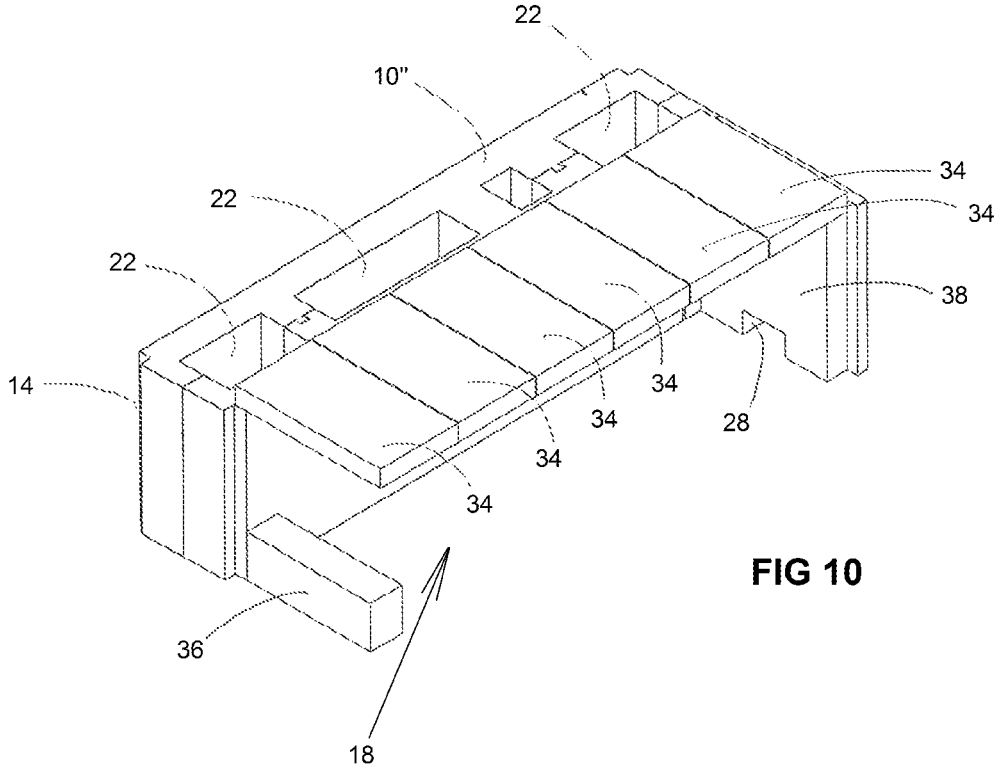
FIG. 10 schematically illustrates a multi-story crypt burial system during a construction state, according to one embodiment of the invention.

FIG. 10 schematically illustrates a multi-story crypt burial system during a construction state, according to one embodiment of the invention.

Block 36, which is derived from block 10" (as illustrated in FIG. 9), is used as a front block of the burial space 18, and block 38 is used as the rear block of the burial space 18.

Blocks 34, also derived from block 10", are used for covering the burial space 18 from above.

Spaces 22 may be used for filling with soil in order to generate a soil sequence to the ground, or filled with reinforced concrete in order to strengthen a matrix of multi-story crypt graves.

Reference numeral 28 represents a cavity that may generate a soil sequence to the earth, according to the Jewish law.

Figure 11:
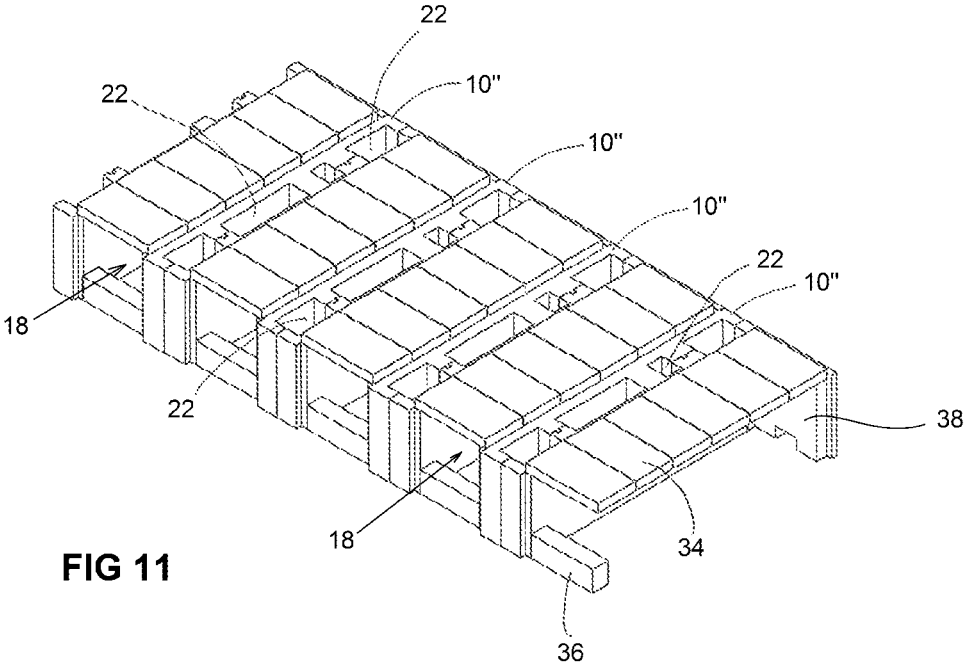
FIG. 11 schematically illustrates a single floor of a multi-story crypt burial system during construction, according to one embodiment of the invention.

FIG. 11 schematically illustrates a single floor of a multi-story crypt burial system during construction, according to one embodiment of the invention.

In this figure the burial spaces 18 are ordered in line.

Figure 12:
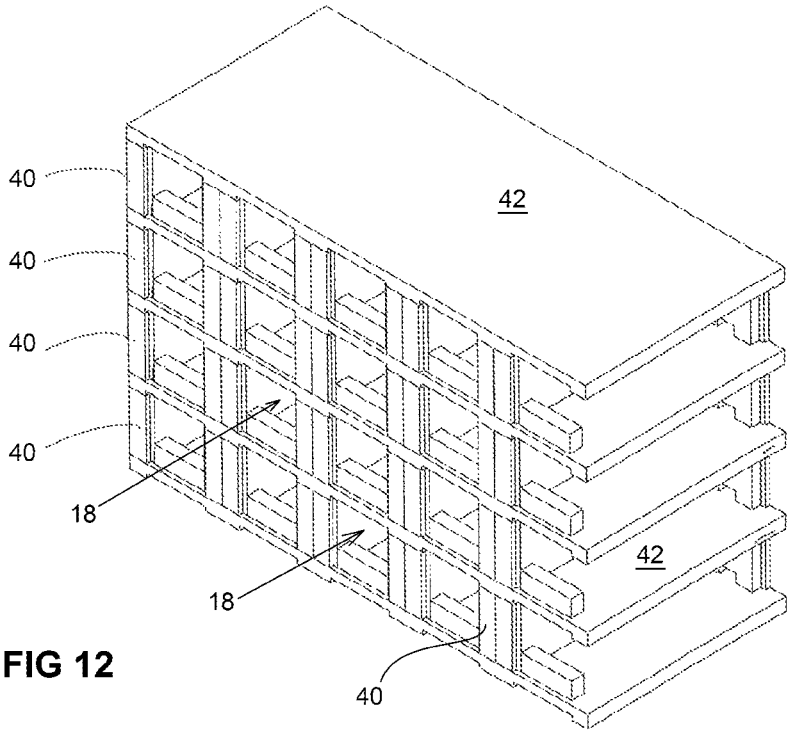
FIG. 12 schematically illustrates a multi-story crypt burial system, according to one embodiment of the invention.

FIG. 12 schematically illustrates a multi-story crypt burial system, according to one embodiment of the invention.

As illustrated, the burial system comprises a plurality of burial spaces 18, arranged in a vertical matrix form, in floors.

Columns 40 are used for strengthening the construction, and block 42 is used as separator between the levels (i.e., floors).

In the figures and/or description herein, the following reference numerals (Reference Signs List) have been mentioned:

numeral 10 denotes an expanded polystyrene grave wall of a single burial system, according to one embodiment of the invention;

numeral 10' denotes an expanded polystyrene grave wall of a double burial system, according to one embodiment of the invention;

numeral 10" denotes an expanded polystyrene grave wall of a multi-story crypt burial system, according to one embodiment of the invention;

numeral 12 denotes a block extracted from a grave wall;

numeral 14 denotes a quadratic recess of a grave wall;

numeral 16 denotes a cutting in a grave wall;

numeral 18 denotes a burial space in a burial system;

numeral 20 denotes a space in a burial system which reaches the earth;

numeral 22 denotes a space in a grave wall, content of which has been extracted for use as a latitudinal wall of a burial space;

numeral 24 denotes an upper supporter of a grave wall;

numeral 26 denotes a lower supporter of a grave wall;

numeral 28 denotes a horizontal cavity in a grave wall;

numeral 30 denotes a vertical cavity in grave walls;

numeral 32 denotes a vertical cavity generated between two grave walls;

numeral 34 denotes a cover plate;

numeral 36 denotes a front block;

numeral 38 denotes a rear block;

numeral 40 denotes a vertical construction column;

numeral 42 denotes a level separator;

numeral 44 denotes soil;

numeral 46 denotes a corpse;

numeral 48 denotes a concrete layer used as a gravestone foundation;

numeral 50 denotes a gravestone; and numeral 52 denotes graves' infrastructure.

In the description herein, the following references have been mentioned:

U.S. Pat. Nos. 5,899,045, 6,370,745, and 5,381,591; and Israeli Patents 108493 and 201598.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The invention claimed is:

1. A modular burial assembly defining at least one generally planar array of generally co-planar burial volumes extending in mutually parallel directions, the assembly comprising:

a first plurality of burial volume side wall elements;

a second plurality of burial volume end wall elements; and a third plurality of grave cover plates, corners of some of said first plurality of burial volume side wall elements and said second plurality of burial volume end wall elements being in the form of recesses, other corners of said first plurality of burial volume side wall elements and said second plurality of burial volume end wall elements, which are not in the form of recesses, being integrated into said recesses, each of said first plurality of burial volume side wall elements and said second plurality of burial volume end wall elements being formed of a foamed plastic material, each of said first plurality of burial volume side wall elements defining at least one side wall surface having a uniform cross-sectional configuration along a horizontal axis thereof, said side wall surfaces of said first plurality of burial volume side wall elements each defining at least one supporter having a horizontally-extending shoulder facing said burial volume;

said grave cover plates extending horizontally, perpendicular to said side wall surface, and supported on said horizontally-extending shoulders of adjacent ones of said first plurality of burial volume side wall elements; and said first plurality of burial volume side wall elements, said second plurality of burial volume end wall elements and said third plurality of grave cover plates being arranged to define said co-planar burial volumes in said generally planar array.

2. A modular burial assembly according to claim 1 and wherein said second plurality of burial volume end wall elements, when arranged in said generally planar array to define said co-planar burial volumes in said generally planar array, also define soil enclosure defining volumes between adjacent ones of said co-planar burial volumes.

3. A modular burial assembly according to claim 1 and wherein said first plurality of burial volume side wall elements, when arranged in said generally planar array to define said plurality of co-planar burial volumes in said generally planar array, also define soil enclosure defining volumes between adjacent ones of said co-planar burial volumes.

4. A modular burial assembly according to claim 1 and wherein said at least one supporter comprises an upper supporter and a lower supporter.

5. A modular burial assembly according to claim 1 and wherein:

corners of said first plurality of burial volume side wall elements are in the form of recesses; and corners of said second plurality of burial volume end wall elements are integrated into said recesses of said corners of said side wall elements.

6. A modular burial assembly according to claim 1 and wherein said recesses are quadratic prismatic recesses.

7. A modular burial assembly according to claim 1 and wherein said recesses provide for locking engagement of said first plurality of burial volume side wall elements and said second plurality of end wall elements to each other.

8. A modular burial assembly according to claim 1 and wherein said foamed plastic material comprises expanded polystyrene (EPS).

9. A modular burial assembly according to claim 1 and wherein each of said first plurality of burial volume side walls and said second plurality of burial volume end wall elements formed of said foamed plastic material weighs up to 3% of a similarly sized concrete burial volume wall.

10. A modular burial assembly according to claim 1 and wherein each of said first plurality of burial volume side wall elements and said second plurality of burial volume end wall elements has a weight density of less than 70 $kg/m^3$.

11. A modular burial assembly according to claim 1 and wherein each of said first plurality of burial volume side wall elements and said second plurality of burial volume end wall elements is moveable by a single worker without mechanical equipment.

12. A method for constructing a modular burial assembly defining at least one a-generally planar array of generally co-planar burial volumes extending in mutually parallel directions, the method comprising:

providing a first plurality of burial volume side wall elements, second plurality of burial volume end wall elements and a third plurality of grave cover plates, corners of some of said first plurality of burial volume side wall elements and said second plurality of burial volume end wall elements being formed as recesses, each of said first plurality of burial volume side wall elements and said second plurality of burial volume end wall elements being formed of a foamed plastic material, each of said first plurality of burial volume side wall elements defining at least one side wall surface having a uniform cross sectional configuration along a horizontal axis axis thereof, said side wall surfaces of said first plurality of burial volume side wall elements each defining at least one supporter having a horizontally-extending shoulder facing said burial volume;

arranging said first plurality of burial volume side wall elements and said second plurality of burial volume end wall elements in said generally planar array to define each of a plurality of said co-planar burial volumes in said generally planar array, said arranging comprising:

integrating other corners of said first plurality of burial volume side wall elements and said second plurality of burial volume end wall elements, which are not in the form of recesses, into said recesses; and extending said grave cover plates horizontally, perpendicular to said side wall surface, said grave cover plates being supported on said horizontally-extending shoulders of adjacent ones of said first plurality of burial volume side wall elements.

13. A method for constructing a modular burial assembly according to claim 12 and wherein when said second plurality of burial volume end wall elements are arranged in said generally planar array to define said plurality of co-planar burial volumes in said generally planar array, said second plurality of burial volume end wall elements also define soil enclosure defining volumes between adjacent ones of said co-planar burial volumes.

14. A method for constructing a modular burial assembly according to claim 13 and also comprising filling said soil enclosure defining volumes between adjacent ones of said co-planar burial volumes with soil.

15. A method for constructing a modular burial assembly according to claim 12 and wherein when said first plurality of burial volume side wall elements are arranged in said generally planar array to define said plurality of co-planar burial volumes in said generally planar array, said first plurality of burial volume side wall elements also define soil enclosure defining volumes between adjacent ones of said co-planar burial volumes.

16. A method for constructing a modular burial assembly according to claim 15 and also comprising filling said soil enclosure defining volumes between adjacent ones of said co-planar burial volumes with soil.

17. A method for constructing a modular burial assembly according to claim 12 and wherein said providing a first plurality of burial volume side wall elements and a second plurality of burial volume end wall elements comprises:

providing a plurality of blocks of said foamed plastic material;

cutting each of said plurality of blocks of said foamed plastic material with a filament, each of said plurality of blocks providing two of said first plurality of burial volume side wall elements and two of said second plurality of burial volume end wall elements.

18. A method for constructing a modular burial assembly according to claim 17 and wherein:

said first plurality of burial volume side wall elements and said second plurality of burial volume end wall elements comprise connectors to connect to each other; and said arranging comprises integrating said connectors to each other for preventing movement of said first plurality of burial volume side wall elements relative to said second plurality of burial volume end wall elements.

19. A method for constructing a modular burial assembly according to claim 12 and wherein:

corners of said first plurality of burial volume side wall elements are in the form of said recesses; and said integrating comprises integrating corners of said second plurality of burial volume end wall elements into said recesses of said corners of said first plurality of burial volume side wall elements.

20. A method for constructing a modular burial assembly according to claim 12 and wherein said arranging comprises moving each of said first plurality of burial volume side wall elements and said second plurality of burial volume end wall elements by a single worker without mechanical equipment.

* * * * *